US006150935A

United States Patent [19]

Anderson

[11] Patent Number: 6,150,935

[45] Date of Patent: Nov. 21, 2000

[54] FIRE ALARM SYSTEM WITH DISCRIMINATION BETWEEN SMOKE AND NON-SMOKE PHENOMENA

[75] Inventor: Donald D. Anderson, Easton, Conn.

[73] Assignee: Pittway Corporation, Chicago, Ill.

[21] Appl. No.: 08/853,605

[22] Filed: May 9, 1997

[51] Int. Cl.[7] ..... G08B 29/00

[52] U.S. Cl. ..... 340/506; 340/507; 340/508; 340/521; 340/523; 340/525

[58] Field of Search ..... 340/507, 508, 340/511, 517, 521, 522, 506, 523, 526, 524, 525, 587, 588, 583

[56] References Cited

U.S. PATENT DOCUMENTS

| | | | |
|---|---|---|---|
| 4,611,197 | 9/1986 | Sansky | 340/522 |
| 4,812,819 | 3/1989 | Corsberg | 340/517 |
| 4,916,432 | 4/1990 | Tice et al. | 340/518 |
| 5,172,096 | 12/1992 | Tice et al. | 340/501 |
| 5,483,222 | 1/1996 | Tice | 340/518 |
| 5,557,262 | 9/1996 | Tice | 340/587 |

FOREIGN PATENT DOCUMENTS 0 760 464 A1 3/1997 European Pat. Off. .

*Primary Examiner*—Daryl Pope
*Attorney, Agent, or Firm*—Rockey, Milnamow & Katz, Ltd.

[57] ABSTRACT

An alarm system which incorporates a plurality of highly sensitive, early warning, smoke detectors incorporates functionality for distinguishing between detector signals in response to ambient smoke and detector signals in response to the presence of non-smoke, fibrous materials. Detectors are spatially arranged in predetermined regions. Information concerning the arrangement of detectors is stored in the common control unit. Additionally, a performance history for each of the detectors is also stored in the control unit. If one of the detectors exhibits a relatively large output which is large enough to indicate a possible fire, a previously stored history from the outputs of that detector is analyzed. If the previously stored history indicates a fire related profile, such as a relatively gradual increase in smoke level over a period of time, the signal from that detector is regarded as being indicative of smoke and an alarm is indicated. If the signal from the detector shows a relatively fast increase, from a very low level to an alarm level in a short period of time, fibrous material may have entered the detector. The output from at least one other detector in the same region is analyzed. If the second detector confirms the presence of smoke, at least the first detector is regarded as indicating an alarm condition. If the second detector does not indicate the presence of smoke, even a very low level of smoke, the output from the first detector is regarded as being due to a non-smoke condition, such as an intrusive fibrous material. The control unit indicates the presence of a trouble or maintenance condition with respect to that detector.

21 Claims, 3 Drawing Sheets

FIRE ALARM SYSTEM WITH DISCRIMINATION BETWEEN SMOKE AND NON-SMOKE PHENOMENA

FIELD OF THE INVENTION

The invention pertains to fault detection of electrical signals received from ambient condition sensors. More particularly, the invention pertains to processing apparatus and methods for minimizing false alarms due to non-smoke variations in electrical signals indicative of ambient conditions such as smoke or fire.

BACKGROUND OF THE INVENTION

Various systems are known for the detection of alarm conditions. One particular form of such a system is a smoke or fire detecting system of a type generally illustrated in previously issued Tice et al. U.S. Pat. No. 4,916,432, assigned to a common assignee and incorporated herein by reference.

Upon receipt of inputs from one or more of the detectors of the system, a control unit associated with the system is able to make a determination as to whether or not a fire condition is present in one or more regions of interest. A variety of techniques have been used in the past for the purpose of making this determination.

Sensors of smoke such as photoelectric smoke detectors or ionization-type smoke detectors are intended to provide outputs indicative of sensed levels of ambient smoke. Environmental noise, such as dust particles or insects which may enter the respective detector can produce variations in output signals from the sensors which are not in any way correlated with the presence of smoke. These noise outputs can produce false alarms if the sensitivity of the respective detector is high enough. Such false alarms are undesirable.

Photoelectric smoke sensors used for early warning typically use a light source and a light sensitive receiver. The design and placement of the light source, receiver, and baffling are such that no significant light from the source normally reaches the receiver unless smoke or other particles are present in the area of the light beam. If smoke or other particles are present in this area, they will scatter the light photons, and cause some of the light to reach the receiver.

In non-early warning smoke detection systems, the density of smoke required at a sensor to cause an alarm is relatively large compared to the density of dust, fibers and other non-smoke particles normally existing in the environment, therefore these systems are not susceptible to false indications caused by such particles. In early warning smoke detection systems, the signals given by low levels of smoke may be comparable to that given by non-smoke airborne particles in the environment that this type of system is typically used.

In prior art early warning systems, filters were used to remove non-smoke particles in the air present in the smoke sensors. The presence of a filter usually requires that the sensor include a fan or other means to draw air through the filter. The mechanical fans and filters used in prior art detectors are expensive, subject to failure, and require regular maintenance.

Thus there continues to be a need for detectors which can be used in early warning systems without requiring the presence of fans or filters. Preferably minimizing false indications could be accomplished without significantly increasing the expense of such systems while avoiding any need to incorporate additional mechanical components.

SUMMARY OF THE INVENTION

A fire detection and alarm system in accordance with the present invention includes a control unit and multiple early warning smoke sensors. Each of these smoke sensors measures the density of smoke particles in its area. Each of the sensors then sends a signal to the control unit which is an electrical indication of that smoke density. The control unit processes the signals from at least some of the sensors and determines if an alarm condition exists.

False indications caused by airborne particles that are not smoke need to be rejected since the system is designed to detect very low levels of smoke. Discrimination between smoke and fiber particles, such as lint or human hair, is a significant benefit of a system than embodies this invention. The design of the smoke sensors, combined with signal processing software in the control unit, permits the described system to detect these fiber particles. This detection feature enables the system to minimize false alarms caused by the presence of such fibers.

The system requires that at least two smoke sensors be installed in each room or enclosed space. The probability that a fiber particle, large enough to cause a false reading, will enter a single smoke sensor is small, but significant. The probability that such a particle will enter two sensors at the same time is so small as to be insignificant.

When the control unit identifies a signal from a first sensor that could be indicative of smoke alarm, it then analyzes the signal and determines if the reading could also be indicative of fiber particle. If the reading from the first sensor could be indicative of a fiber particle, the control unit then analyzes a reading from a second detector known to be in the same room.

If, during a predetermined period of time, no readings from the second sensor are received that could be indicative of even a small level of smoke, then the control unit will provide an indication that the signal at the first sensor has been caused by a fiber particle or some other non-smoke phenomenon. A maintenance or trouble signal can then be generated.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
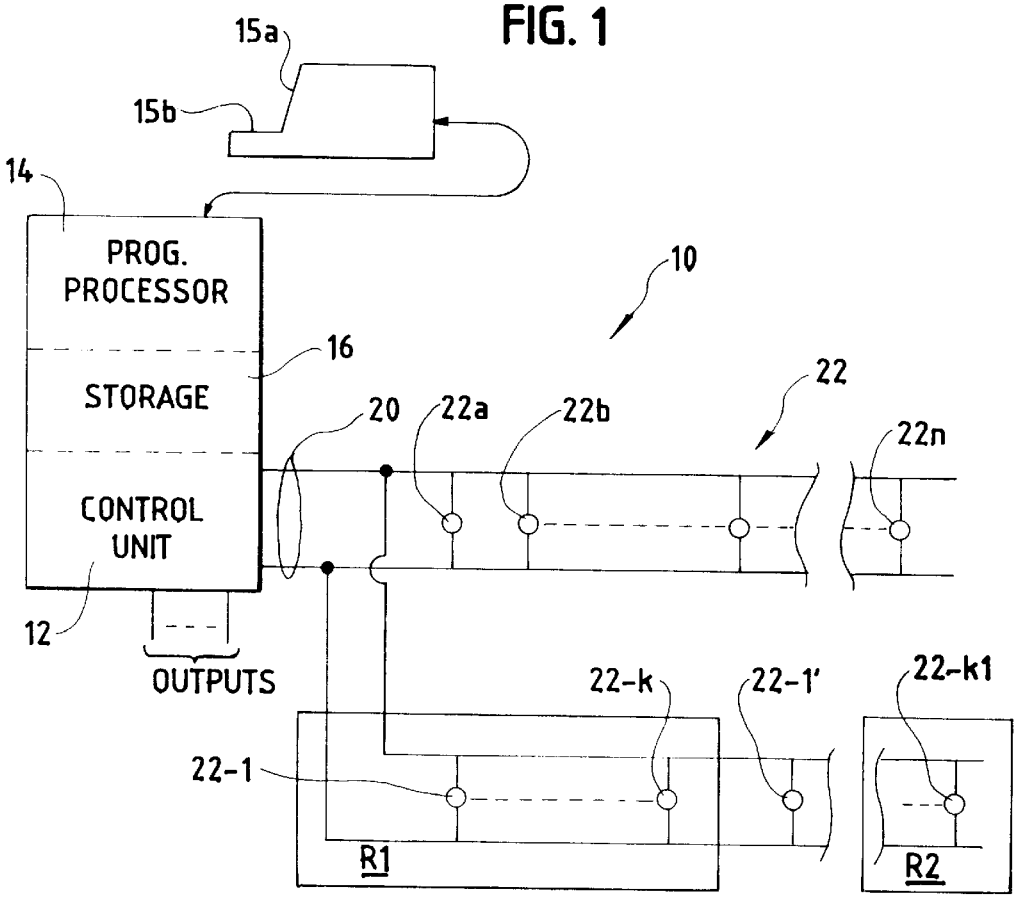
FIG. 1 is a block diagram of an alarm system.

While this invention is susceptible of embodiment in many different forms, there are shown in the drawing, and will be described herein in detail, specific embodiments thereof with the understanding that the present disclosure is to be considered as an exemplification of the principles of the invention and is not intended to limit the invention to the specific embodiments illustrated.

FIG. 1 illustrates a block diagram of a system 10 in accordance with the present invention. This system 10 includes a control unit 12, which can be implemented with a programmable processor 14 and a storage unit 16. The storage unit 16, can include both control programs and data storage regions for use by the processor 14.

The control unit 12 is coupled by a bidirectional communication link 20 to a plurality of ambient condition sensors or detectors generally indicated at 22. The members of the plurality 22, such as sensors 22*a*, 22*b* . . . 22*n* are intended to detect a particular ambient condition in an adjacent region. The system 12 can also include an operator display unit with an output visual display device 15*a* and an operator control or input device such as keyboard 15*b*.

The control unit 12 also includes a plurality of system outputs. The outputs can be used to activate audible or visual alarms. In addition, the unit 12 can be coupled to ventilation or air handling systems in the building so as to control smoke migration.

Representative types of detectors include ionization-type or photoelectric-type smoke detectors. Temperature sensors as well as other types of ambient condition sensors could be used in the system 10 in accordance with the present invention.

More particularly, the system 10 is intended to monitor one or more regions, for example regions R1, R2 which might or might not be contigious. Two or more detectors 22-1, 22-2 . . . 22-k are located in region R1. Detectors 22-1'. . . 22-k' are located in region R2. The regions R1, R2 can be substantially closed rooms for example.

Figure 2:
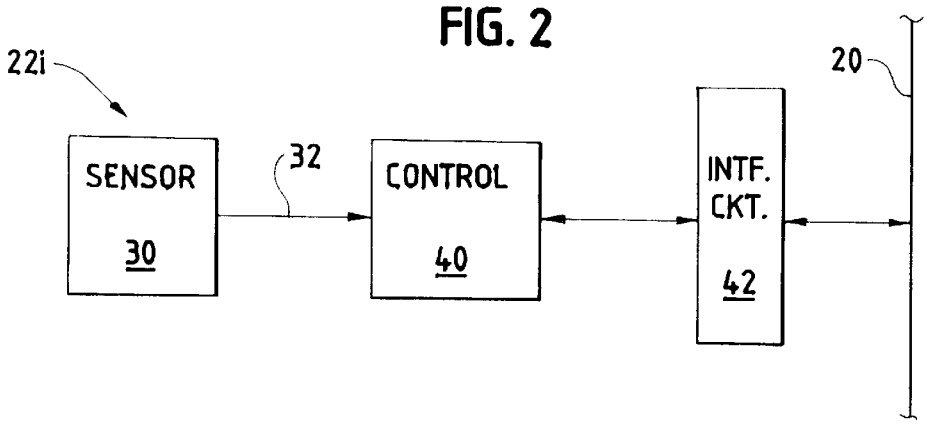
FIG. 2 is a block diagram of a detector usable with the alarm system of FIG. 1.

FIG. 2 is a block diagram representation of a detector 22*i* useable with the system 10. The detector 22*i*, includes a sensor element 30. The element 30 is intended to sense a particular ambient condition, such as smoke, temperature, infrared radiation or the like and it generates an electrical system indicative thereof on a line 32.

Referring again to FIG. 2, output from the sensor 30, on the line 32 is coupled to a local detector control element 40. The control element 40 could be implemented with either digital or analog circuitry. If in digital form, the control element 40 could be implemented as either hard wired logic or could incorporate a programmed microprocessor. The control element 40, via interface circuitry 42 is capable of carrying on bidirectional communication with the system control unit 12, via the communication link 20.

A method in accordance with the present invention, to be described subsequently, could be implemented in either the system control unit 12 or the detector local control element 40 without limitation. Implementation can be by either hardwired circuitry or by means of a programmed microprocessor also without limitation.

Figure 3:
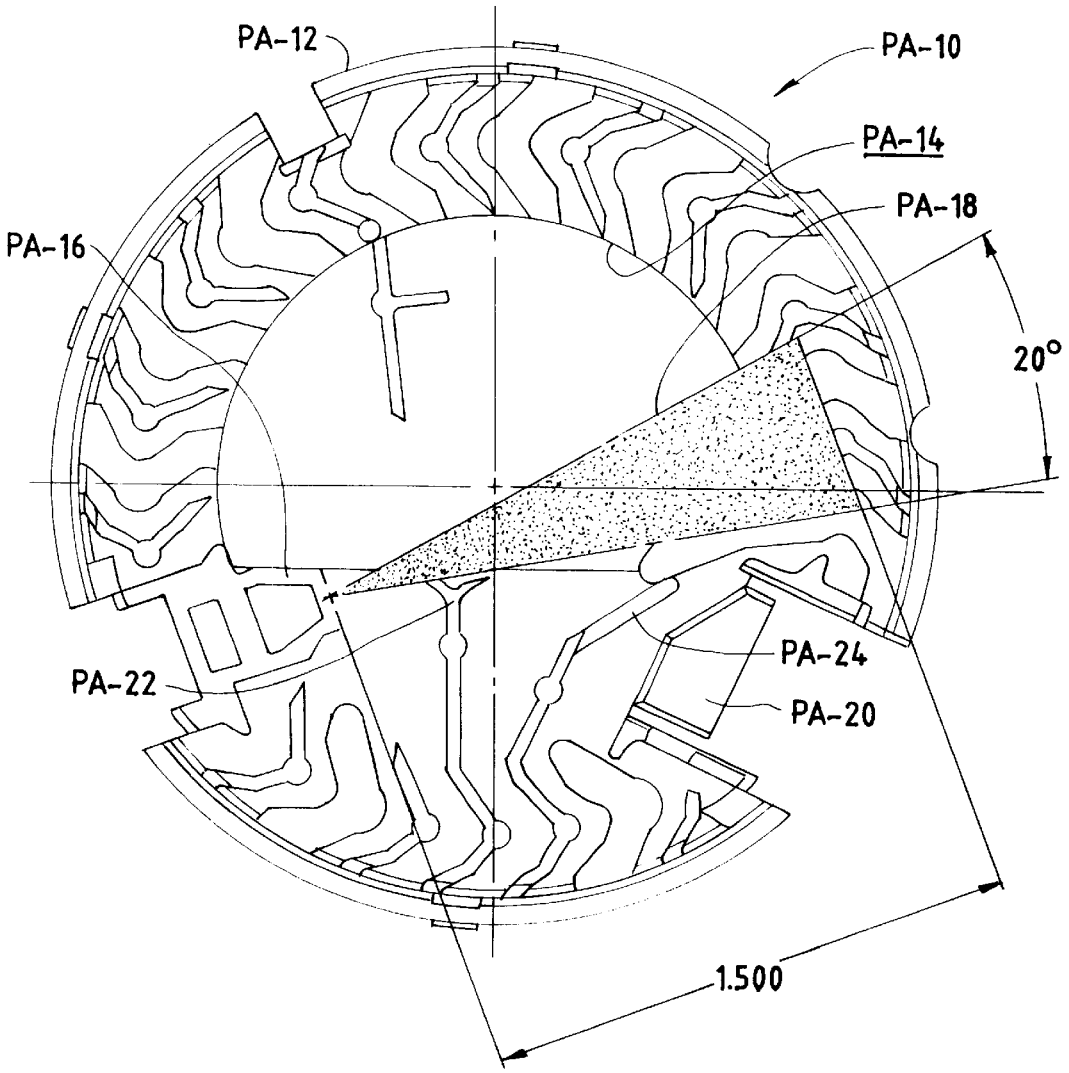
FIG. 3 PRIOR ART
FIG. 3 is a sectional view of a prior art photoelectric detector.

FIG. 3 illustrates in cross-section, a prior art photoelectric chamber PA-10. This chamber includes a housing PA-12 with an internal sensing volume PA-14.

A light emitting source, PA-16 is carried on the housing and oriented to emit a beam of light PA-18 into the internal light sensing region PA-14. As is illustrated in FIG. 3, the emitted light beam PA-18 exhibits a somewhat conical expanding shape as it traverses the region PA-14. The light beam PA-18 is directed toward and absorbed on the housing PA-12.

Offset from the axis of the beam PA-18 is a photoelectric sensor PA-20. The sensor PA-20 is oriented such that light from the beam PA-18 which has been scattered by particulate matter in the volume PA-14 will be incident thereon thereby generating an output electrical signal.

Elements PA-22 and PA-24 limit the amount of light which can fall upon the sensor PA-20.

The effective sensing light volume, which is the region in which smoke particles can be detected. for the geometry of the chamber PA-10 is on the order of 0.064 cubic inches.

Figure 4:
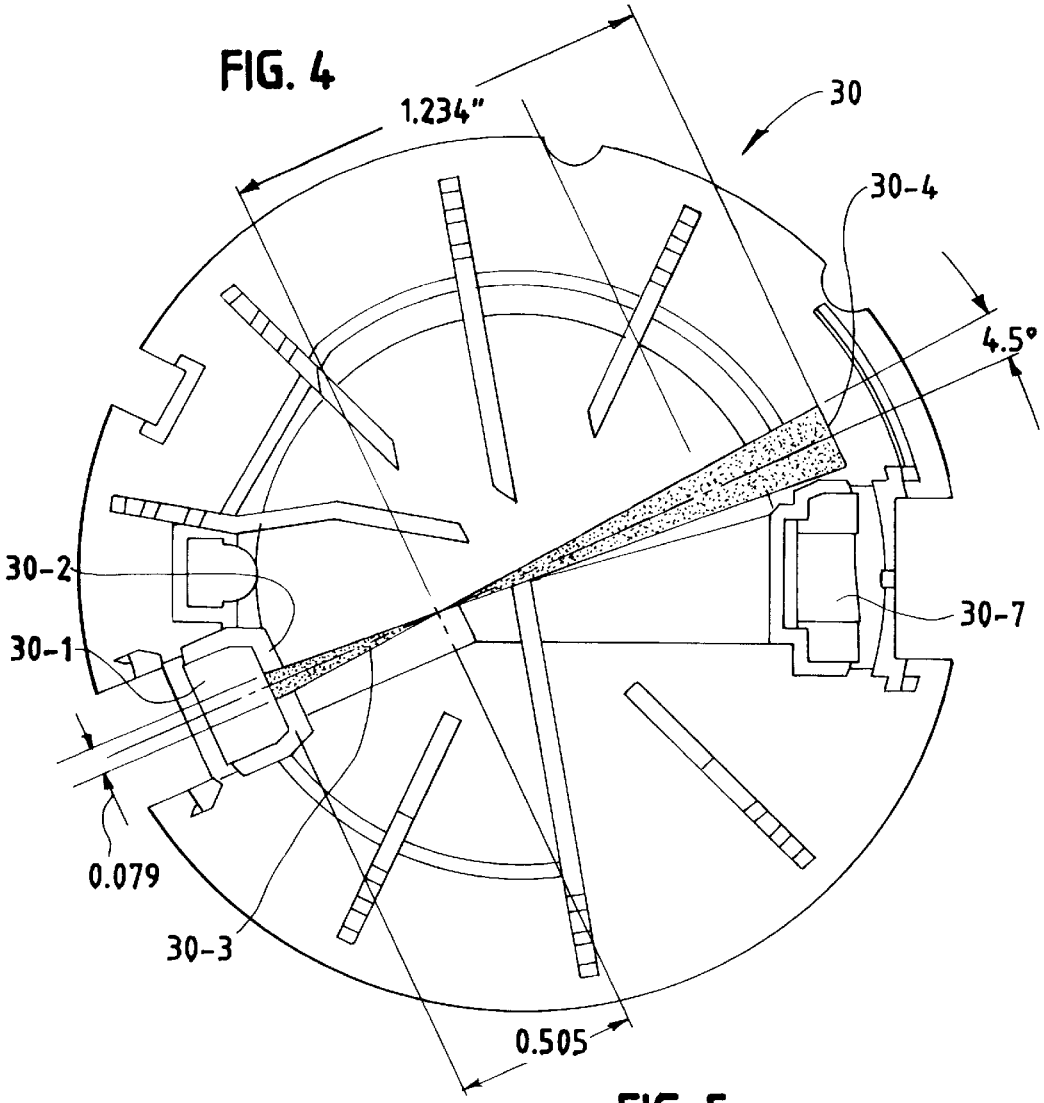
FIG. 4 is a sectional view of a photoelectric detector.

FIG. 4 is a cross-sectional drawing of a smoke sensing chamber 30 of a representative smoke detection device such as 22*i* in accordance with the present invention. The housing 30 could, for example, have a diameter on the order of three inches or less. For example, a housing with a diameter on the order of two and one-half inches or less could be used.

A high intensity source of coherent light 30-1, such as a laser or a laser diode, is carried by the housing or chamber 30. The light source is pulsed to cause it to emit a short pulse of light at periodic intervals (every few seconds).

A lens 30-2 focuses the light into a small but intense beam 30-3. The light beam 30-3 continues through the detector chamber until it strikes a light trap 30-4 at the opposite end of the chamber. The light trap absorbs most of the light, and reflects a small amount away from the central chamber area.

Preferably, source 30-1 in combination with the lens 30-2 will produce a beam 30-3 having an effective beam or light sensing volume on the order of 0.0022 cubic inches. This beam volume is on the order of 3% that of prior art detectors.

Hence, dust particles are large compared to the diameter and volume of the beam 30-3. The dimensions of light beam 30-3 as well as those of the sensing beam volume are smaller than a typical distance between ambient dust particles. As described subsequently, this reduced volume makes the detector 30 less likely to produce dust induced output signals which appear to be due to the presence of smoke.

Figure 5:
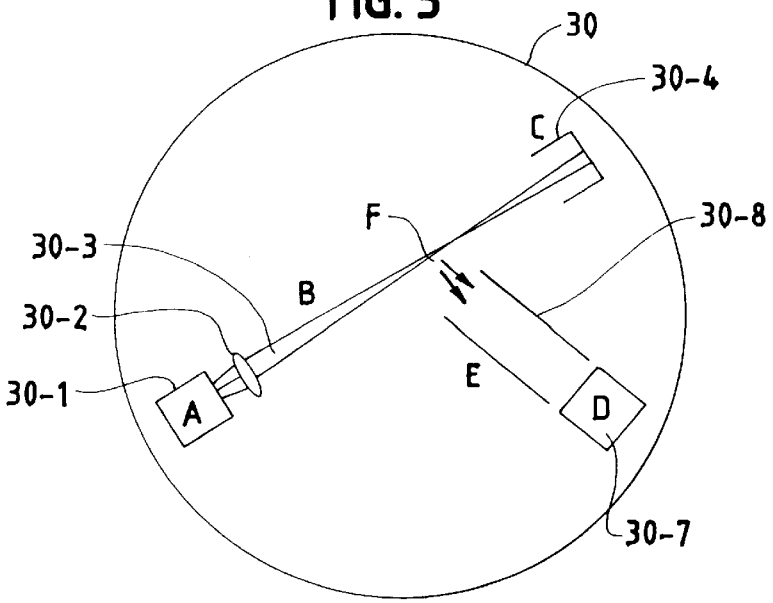
FIG. 5 is a schematic representation of a detector containing a fibrous element.

Suitable early warning detectors were discussed previously. As illustrated in FIG. 5 such smoke detectors can also include a collector or baffle of scattered radiant energy 30-8.

As discussed above, the volume of the light beam in which scattered light particles can reach the sensor 30-7 is small in comparison to the volume of the sensor. This small volume is called the Effective Scattering Volume (ESV).

Smoke particles are small and numerous compared to dust and fiber particles, which are relatively large and sparse. The ESV is designed so its dimensions are small relative to the typical distance between large airborne dust particles, yet large relative to the distance between smoke particles in a true fire. In this way is very unlikely that more than one large dust particle (large enough to give a significant signal at the sensor 30-7) will occupy the ESV at the same time. Since the airborne particles are in constant motion, the occasional dust particles will cause a transient signal at the sensor 30-7 as the dust particles pass in and out of the ESV. Smoke particles generate a relatively constant signal at the sensor because many are in the ESV, and as some pass out of the ESV, others move in.

Fiber particles may perform similarly to dust (i.e. pass through the ESV and cause only a transient signal). However, since they are very long in one dimension, it is possible that one end of the fiber may touch a surface in the sensor and the other end encroach on the ESV. This situation is illustrated in FIG. 5. Fiber particle F has entered the detector illustrated therein.

Since the fiber F is not airborne, it may remain in this position for a long period of time and provide a constant signal to the sensor 30-7 and control unit 12. Since fiber particles are typically very large compared to smoke particles, their presence can cause a false alarm unless steps are taken to detect their presence.

The present system and method discriminate between smoke and fiber particles. When a signal received from a first detector is large enough to indicate a possible fire, the control processor 14 via software first analyzes previous measurements stored in memory 16 for that detector. If the previous stored readings exhibit a profile indicative of a fire condition, such as a relatively gradual increase over time, the signal from that detector is indicative of smoke and an alarm is indicated by and at the control unit 12. It will be understood that other fire profiles can be used. For example, the slopes of the output signals from the first detector can be compared to a preset value. Alternately, pattern recognition techniques could be used without departing from the spirit and scope of the present invention.

If the signal received from that detector shows a relatively sharp increase, from a very low level to an alarm level in a few seconds, this could possibly be a fiber, and the alarm indication is delayed for further analysis. If the signal received from that detector is determined, as above, to be possibly indicative of a fiber, the control unit 12 then analyzes the signals received from a second detector known to be located in the same room or physical space.

For example, in FIG. 1, if a possible fiber or smoke alarm indication is received from detector 22-k, the control unit 12 will examine the output from detector 22-1, not detectors 22-1' or 22-k'. If no significant signal, even a very low signal, is received from detector 22-1, (which is in the same room R1), for a predetermined time period, this is further evidence that the signal at the detector 22-k is caused by a fiber particle and not smoke. If this lack of signal at the second detector 22-1 occurs, the control unit 12 does not indicate an alarm but instead indicates on its display 15*a* that a fault condition exists in the detector 22-k and that detector must be checked or cleaned. If instead, during the predetermined time period, a small analog signal is being sent from the second detector 22-1, the control unit 12 will indicate an alarm condition for the first detector 22-k.

It will be understood that the outputs from other detectors, 22-2, 22-3 in the region R1 can also be analyzed in this process. A preferred analysis time is in a range of 5 to 60 seconds.

From the foregoing, it will be observed that numerous variations and modifications may be effected without departing from the spirit and scope of the invention. It is to be understood that no limitation with respect to the specific apparatus illustrated herein in tended or should be inferred. It is, of course, intended to cover by the appended claims all such modifications as fall within the scope of the claims.

What is claimed is:

1. A method of assessing the presence of a fire condition in one or more regions being monitored with an alarm system having a control unit linked to a plurality of displaced smoke detectors, the method comprising:

establishing at the control unit records of the detectors associated with a plurality of pre-defined, regions being monitored by the alarm system;

receiving at the control unit signals from the detectors indicative of a sensed level of smoke at the respective detectors;

for at least the signal from a first detector, determining if a possible fire condition may be present in the vicinity of the first detector;

responsive to said possible fire condition, determining if the record of the first detector exhibits a predetermined trend during a selected time interval, and, in response to the presence of the predetermined trend, producing a signal indicative of an alarm condition, but in the absence of the predetermined trend, evaluating the signal from another detector, located in the same region as the first detector and in the absence of a predetermined signal from the another detector, indicating a fault condition at the first detector.

2. A method as in claim 1 wherein at least some of the regions are substantially enclosed.

3. A method as in claim 1 wherein the predetermined trend indicates an increasing level of smoke over a predetermined period of time.

4. A method as in claim 1 including:

in the presence of a predetermined signal from another detector, indicating an alarm condition.

5. An alarm system comprising:

a control unit;

a communications link coupled to the control unit;

a plurality of spaced-apart ambient condition detectors coupled to the communications link wherein the detectors transmit signals indicative of ambient conditions sensed in regions adjacent to the respective detectors and wherein the control unit includes circuitry for determining if a signal received from a selected detector in a predetermined region is indicative of the possible presence of a foreign element in the detector and additional circuitry in the control unit for determining whether a second detector in the same region has transmitted signals to the control unit of a magnitude too low to be indicative of a possible alarm condition for a predetermined time interval; and circuitry for indicating the presence of an alarm condition in response thereto.

6. An alarm system comprising:

a control unit;

a communications link coupled to the control unit;

a plurality of spaced-apart ambient condition detectors coupled to the communications link wherein the detectors transmit signals indicative of ambient conditions sensed in regions adjacent to the respective detectors and wherein the control unit includes circuitry for determining if a signal received from a selected detector in a predetermined region is indicative of the possible presence of a foreign element in the detector, additional circuitry in the control unit for determining whether a second detector in the same region is transmitting signals to the control unit indicative of a possible alarm condition;

circuitry for indicating the presence of an alarm condition; and wherein the control unit includes circuitry for storage of prior signal values from the selected detector.

7. A system as in claim 6 wherein at least some of the detectors sense ambient smoke.

8. A system as in claim 6 wherein the determining circuitry analyzes the stored prior values for the detector and in response to a trend indicating a fire condition, enables the circuitry for indicating the alarm condition.

9. A system as in claim 8 which includes delay circuitry in the event that the trend does not indicate a fire condition.

10. A method of determining an alarm condition in response to signals received from a plurality of displaced smoke detectors, the method comprising:

receiving signals from at least two detectors in a selected region being monitored;

in response to one of the received signals changing in a way indicative of a possible fire, analyzing the one received signal using a stored history, and then another received signal to differentiate between a fire condition and a non-fire condition.

11. A method of determining an alarm condition in response to signals received from a plurality of displaced smoke detectors, the method comprising;

receiving signals from at least two detectors in a selected region being monitored;

in response to one of the received signals changing in a way indicative of a possible fire, analyzing the one received signal and then other received signals to differentiate between a fire condition and a non-fire condition; and which includes storing a history of signals received from at least one of the detectors.

12. A method as in claim 11 wherein the stored history is used during the analyzing step.

13. A method as in claim 12 wherein if the stored history includes a profile which indicates that a fire is probable, then an alarm is indicated.

14. A method as in claim 12 wherein if the stored profile does not indicate that a fire is probable, indication of an alarm is delayed.

15. A method as in claim 14 in the absence of a fire profile, analyzing the other received signal to determine if it is indicative of a fire condition and if not, indicating that a selected non-alarm fault condition may be present at the one detector.

16. A fire alarm system in which multiple smoke sensors are monitored by a control panel, and said smoke sensors send signals to said control panel that indicate the level of smoke sensed by said smoke sensors, and said control panel uses said signal received from a first smoke sensor to determine if a possible alarm condition exists, and if the signal from said first sensor has a sharp increase with respect to time, said control panel performs further processing of the signals from a second sensor before making a decision that a fire alarm condition exists at said first sensor or making a decision that a special non-fire condition exists at said first sensor.

17. A system as in claim 16 where said control panel indicates that a fire alarm condition exists at said first sensor if the signal from said second sensor exceeds a predetermined level for a predetermined time.

18. A system as in claim 16 where said control panel indicates that a special non-fire condition exists at said first sensor and that maintenance action is necessary if the signal from said second sensor rises above a predetermined level during a predetermined time.

19. A method of assessing the presence of a fire condition in one or more regions being monitored with an alarm system having a linked plurality of displaced ambient condition detectors, the method comprising:

receiving signals from the detectors indicative of sensed ambient condition at the respective detectors;

storing performance histories of at least some of the detectors;

for at least the signal from a first detector, determining if a possible fire condition may be present in the vicinity of the first detector;

responsive to said possible fire condition, determining if the performance history of the first detector exhibits a predetermined confirmatory trend during a selected time interval, and, in response to the presence of the confirmatory trend, producing a signal indicative of an alarm condition, but in the absence of the trend, evaluating the signal from another detector, located in the same region as the first detector, and, in the absence of a predetermined signal from the another detector, indicating a fault condition at the first detector.

20. A method as in claim 19 wherein the confirmatory trend indicates an increasing level of sensed ambient condition over a predetermined period of time.

21. A method as in claim 19 including:

in the presence of a predetermined signal for a predetermined time interval from another detector, indicating an alarm condition.

* * * * *